United States Patent [19]

Franzmann

[11] 4,123,960

[45] Nov. 7, 1978

[54] DEVICE FOR THE MANUAL PLAYING OF ELECTRONIC MUSICAL INSTRUMENTS

[76] Inventor: Rainer Franzmann, Mittelstrasse 24, 2000 Norderstedt 2, Germany

[21] Appl. No.: 776,812

[22] Filed: Mar. 11, 1977

[30] Foreign Application Priority Data

Mar. 15, 1976 [DE] Fed. Rep. of Germany ..... 2610782

[51] Int. Cl.[2] ..... G10H 3/06

[52] U.S. Cl. ..... 84/1.17; 84/424; 84/450

[58] Field of Search ..... 84/1.01, 1.17, 423, 84/424, 425, 450, DIG. 7

[56] References Cited

U.S. PATENT DOCUMENTS

| | | | |
|---|---|---|---|
| 1,239,609 | 9/1917 | Little | 84/425 |
| 3,227,027 | 1/1966 | Von Gunten | 84/425 |
| 3,797,357 | 3/1974 | Thomas et al. | 84/423 |
| 3,941,023 | 3/1976 | Thomas et al. | 84/1.01 |

*Primary Examiner*—Robert K. Schaefer
*Assistant Examiner*—Vit W. Miska
*Attorney, Agent, or Firm*—Stonebraker, Shepard & Stephens

[57] ABSTRACT

A console for use in playing an electronic musical instrument. Two manuals are slidably arranged on a stationary frame or desk, to slide sideways toward and away from each other. Each manual carries various keys and other movable control elements to be operated by one arm-hand-finger of the player. On each manual, keys for individual tones are arranged in rows extending front to back, toward and away from the player, rather than in rows extending from side to side as in a conventional piano keyboard. Each key is wide enough so that two fingers of the player may rest simultaneously on the key. In addition to these rows of keys, each manual has other special keys or movable elements, some arranged for operation by the little finger, some for operation by the thumb, some for operation by raising or lowering the hand, for changing the nature, quality, duration, octave, or other characteristics of the sound produced. In a console intended to be played by a player who is normally right handed, the right hand manual contains the full complement of the special keys or control elements, and the left hand manual may omit some of them. The reverse is true if the console is designed for playing by a normally left handed player. Except for such possible omission, the right hand manual and left hand manual are complementary or mirror image duplicates of each other.

16 Claims, 8 Drawing Figures

DEVICE FOR THE MANUAL PLAYING OF ELECTRONIC MUSICAL INSTRUMENTS

BACKGROUND OF THE INVENTION

The invention relates to electronic musical instruments, where the various sounds or noises are produced by electronic means.

It should be emphasized at the outset that the present invention relates to the means for playing the electronic instrument, that is, to the various keys and movable control units or elements operated by the right and left arm-hand-finger parts of a human person, rather than to the mechanical or electronic means for producing noise or sound or determining the nature and quality thereof. The mechanical and electrical construction of the sound or noise producing parts, including the manner in which different kinds of sound are to be produced, is either well known in the art, or within the competence of skilled workers in the field, after they have read the present disclosure and learned from this disclosure what effects the various keys and movable control elements are intended to produce. Therefore, no attempt is made here to disclose details of wiring or circuitry, or of various electrical or electronic vibrators or noise producers, it being sufficient for present purposes to indicate merely the effect which is to be produced by operation or movement of a particular key or control element. It is believed that skilled workers in the electronic instrument field have the competence to provide means to produce the desired sound effect when they learn, from the present invention disclosure, what effect is desired to be produced upon movement of a particular key or control element herein disclosed.

Electronic musical instruments, in comparison to historical non-electronic musical instruments, have the advantage that their tone basis can be developed to an optimal technical functional manner in each case, so that at the present state of technology, almost all theoretically possible tone elements can be generated and represented. Whether such a largely unlimited working tone basis is to be provided in any particular case, is largely a question of the individually justifiable economic expense.

The well known electronic musical instruments adapted for direct control can be divided into two main groups or classes, depending on their playing basis. In this connection, the term direct control means that the instrument is played directly by movements of a part of the human body, such as the arm-hand-fingers member or the leg-foot member of the body, as distinguished from instruments played by indirect control, such as those controlled by a prearranged tape or other prearranged mechanism. Also, for present purposes the term playing basis means the parts of the instrument to which are touched or moved by the human body, while playing the instrument. In these two main groups or classes of directly controlled electronic musical instruments, the first group is those whose playing bases are completely different from the keyboard of the historical stringed piano. This applies, for example, to the Trautonium, which has one or more ribbon manuals as an essential part of its playing basis. Directly controllable synthesizers may also have ribbon manuals.

The second group or class of directly controlled electronics musical instruments are those which have a keyboard similar to that of the historical stringed piano as the essential part of their playing basis. Nearly all electronic musical instruments belong to this second group. These include what are called electronic organs, as well as directly controlled synthesizers. The reason why such keyboards are so commonly provided as the playing basis for electronic musical instruments, is probably that the playing technique is simple and easy to learn, and the playing technique is in the complete command of the majority of players. In addition to the keyboard of the historic piano, the manual playing devices of electronic instruments of this class often have special keys as playing helps, with which complex tone elements, such as chords, can be produced.

Both of these main groups or classes of electronic musical instruments have so-called registries. These are groups of action converters with which specific tone elements or different modes of operation of the other action converters, continuously used when playing, can be preselected. These action converters normally have the shape of electrical switch keys or controllers.

As the keyboard of the historical piano type is meant to be the essential part of a playing basis for electronic musical instruments, this leads to the fact that only a few tone elements can be controlled at the same time, and that the infinitely variable control of tone elements is very limited. This results from the fact that normally only three or four control items are available, with such a keyboard. These control items are the place or position of the key, the duration of pressing the key down, the acceleration of the pressed key, and the key pressure against the lower limit of depression of the key. Usually the place or location of the key determines the pitch of the sound which is produced. The start or commencement, the duration, and the muting of the tone are controlled by the duration of the pressure on the key. The sound intensity can be controlled by varying the degree of acceleration of the key which is pressed. The sound intensity, the timbre, or the pitch of the tone can be influenced by the amount of key pressure, that is, the amount of force used in pressing the key at the bottom or lower limit of its downward motion. For the control of additional tone elements, it is necessary to add further action converters. These additional action converters are controlled by extra or additional effectors. Thus, for example, the infinitely variable control of the total volume or the pitch are often rendered by the leg-foot effector group, through so-called foot or knee pedals. This is a kind of control with which a subtle control is extremely difficult.

Consequently, one can state with assurance that the use of keyboards of the historic piano type leads to a considerable limitation of the controllability of electronic musical instruments in their sound effects. That is why the technical advantages of electronic sound generation have not been able to be used for the presentation of music in a sufficient degree. Because of the limited output of such keyboards, the well known and conventional electronic musical instruments, like the historic musical instruments with mechanical sound generating parts, have a particular sound pattern. They do not reach the degree of a universal musical instrument, however. That is, because of the limitations inherent in the conventional piano type of keyboard used on an electronic musical instrument, even with addition of a few extra keys or control elements of the kind heretofore used, the scope of possible sound effects is still quite limited. What may be called the sound world or sound ensemble of the European music culture can not be decisively extended in new directions and new types of effects, using these known types of electronic musical instruments controlled by keyboards of the piano type.

The playing bases of the first main group or class of electronic musical instruments show even more serious disadvantages in comparison to the playing bases of the second group, that is, the group having a keyboard somewhat similar to that of a piano. The total output of the playing bases of instruments of the first group causes an even worse controllability of the sound. The most serious shortcoming arises from the extreme difficulty of playing quick single tone scales and chords.

The present invention deals with the matter of creating a manual playing device for electronic musical instruments of the direct control type, that is, where the playing is performed by movements of parts of the human body such as the arm, the hand, or the fingers. According to the present invention, a special console is provided, differing in many ways from the conventional piano type of keyboard. With this specific manual playing device of the present invention, a maximum number of different tone elements can be controlled, using the easiest possible playing technique. Thus the capacity performance of a largely unlimited working electronic sound bases can be used for the presentation of music at a maximum degree.

Through a great utilization of the capacitive performance of the effectors, as many different sound elements as possible are controlled synchronously. With just one person playing, there can be a great number of autonomous channels.

This is accomplished, according to one aspect of the present invention, by the use of a small and light weight basic unit or manual, placed movably on a playing board, this manual carrying action converters which are located in convenient positions for playing and controlling actions of one arm-hand-finger group of effectors only. The main keys for controlling action are located in the action range of the forefinger, middle finger, and ring finger. A small console with a group of special keys is simultaneously in the action range of the small finger, while other special keys are simultaneously in the control range of the person's thumb. In addition to the main keys, there are also special keys which are within the action range of the forefinger, middle finger, and the thumb. Also, in the resting range of the hand there is what may be called a trestle unit or support on which the hand may rest, the trestle being movable upwardly and downwardly as the hand and the arm of the player move upwardly and downwardly, this upward and downward movement of the trestle unit serving to control still other characteristics of the sound produced by the electronic instrument. In addition, when the hand is on this trestle unit, special keys for further control of the sound output are within the control action range of the forefinger, middle finger, ring finger, and little finger.

The various keys and other movable parts which are moved by the fingers, hand, or other parts of the body of the person playing the instrument, may be referred to broadly as action converters. The basic unit and the action converters carried thereby are electrically connected with the electronic sound producing and sound modifying elements of the musical instrument, in such a way that manual actuation of the action converters will produce the desired sound producing or sound modifying effect. As already explained at the outset, the present invention deals with the physical arrangement of the action converters (keys or other manually movable elements) rather than with the electronic mechanism, and it is within the skill of workers in the electronic musical instrument field to provide the electronic equipment and circuitry necessary to produce the described sound effects and modifications.

For purposes of describing the layout and the movements of the different parts thereof, it will be convenient to refer to the conventional three rectangular coordinates. For purposes of this invention, the $x$-axis is regarded as the horizontal axis passing from side to side, that is, in the direction of the length of a keyboard in a conventional piano. The $y$-axis is the horizontal axis perpendicular to the $x$-axis, that is, passing from front to back or vice versa. The $z$-axis is the vertical or up and down axis.

The basic unit comprises a casing or housing which is movably combined by a sliding device with the sliding devices of the playing board. The latter are arranged in the $x$ direction, that is, in the direction of the above mentioned $x$-axis. The person playing the instrument, by moving his arm suitably, causes the basic unit (which may also be called a manual) to change its position along the $x$-axis and this causes a variable control of sound elements either in a continuous manner or stepwise by degrees or steps, as may be preferred. This travel of the manual along the $x$-axis is supplemented by a supplementary traveling device whereby the trestle unit is movable in the direction of the $y$-axis, and this brings about a further variation of the sound elements either as a continuous variation or as a stepwise variation.

The main keys, the main purpose of which is to make possible the control of the pitch of single notes, are combined in a keyboard in which the pitches of a tone system are graded in the $y$ direction as their main direction, as distinguished from the conventional piano keyboard in which the notes are graded in the $x$ direction. Furthermore, the number of these main keys is limited in such a way that only a part of the total tone range of the sound bases is represented by these main keys which, however, cover the tone range of one complete octave.

The special keys on the console in the action range of the little finger work mainly in the manner of controllers. Thus when touching them with the little finger, the stage values of sound elements or playing helps can be controlled.

The special keys or similar means on the console in the action range of the thumb normally controls sound elements in an infinitely variable manner, that is, through a continuous range rather than stepwise.

Additional special keys on the console are in the action range of the thumb. They work like switches, and serve the purpose of a registry. This purpose can be fulfilled quickly when playing by using the player's forefinger, middle finger, and thumb.

The resting and holding devices of the trestle unit or support unit are arranged at such a height above the main keys that easy actions of motion can be achieved with those fingers that play the main keys. Moreover, they are movably fixed on the trestle unit for movement in the $z$ direction or vertical direction. Thus by resting or putting down ones hand to cause downward movement of the trestle unit, or raising the hand to allow upward movement of the trestle unit under its own spring power, control of sound elements can be achieved either in a continuous (infinitely variable) manner or in a stepwise manner, as may be preferred.

Special keys on the trestle unit act as controllers and serve chiefly as registries. When playing, this can be achieved by the fingers, or by those parts of the hand that rest upon the registry.

The playing board is of such a size that it accommodates two manuals, one for each hand of the player. The manuals are reversed duplicates of each other, that is, reversed from side to side, left to right, except that some of the special keys may be omitted from the left hand manual if the player is right handed, or may be omitted from the right hand manual if the player is left handed and wishes to use his left hand for the major control functions.

DESCRIPTION OF THE PREFERRED EMBODIMENTS

The playing device of the present invention is designed to render possible an almost unlimited presentation of the known sound world of European music-culture, and in addition, to make accessible the production of new musical forms of expression not previously possible.

The sound bases of this electronic musical instrument consists chiefly of purely electronically working appliances for vibration generation and sound modeling, and of a power output stage for accumulation and transformation of energy, adapted to be connected to conventional electric means (that is, plugged into a conventional outlet), and of rear position loud speaker units as sound repelling appliances. All of these parts are either well known in the art, or can be produced within the skill of workers in the at, and are subject to wide variation, the details not being part of the present invention. The present invention, as already indicated above, deals with the location and arrangement of the various playing instrumentalities or facilities, such as the keys and associated parts intended to be moved or operated by the arms, hands, and fingers of the person playing the instrument. As for the action converters, the conversion of the mechanical control processes and control phases into adequate electronic control signals can be carried out well within the skill of the art.

Preferably the playing bases should be so designed as to render possible the control of at least three channels by one player. Two of these channels are under the control action of the arm-hand-fingers groups of effectors (one by the right arm, etc., and one by the left arm, etc.) and one or two additional channels can be controlled by the control action of the leg-foot effector group. One can apportion a differing importance to the presentation possibilities of these channels, in order to employ the technical abilities of the player optimally to his capacity. For example, one can establish that the channel controlled by the right arm-hand-fingers effector group supplies the most presentation facilities, that the channel of the left arm-hand-fingers group supplies less presentation facilities, and that the channel controlled by the leg-foot effector-group supplies even less presentation facilities. Of course one can also establish different importances to the different channels, if this is desired. For example, one can apportion the highest importance to the left manual channel, in the case of a left handed player.

As here used, the term manual playing device comprises all action converters including their carrier and completion contrivances, as far as they are connected with each other into a system. The single basic unit with all its appliances is an integral part of the manual playing device, and can be called a manual. It is the most important part.

Figure 1:
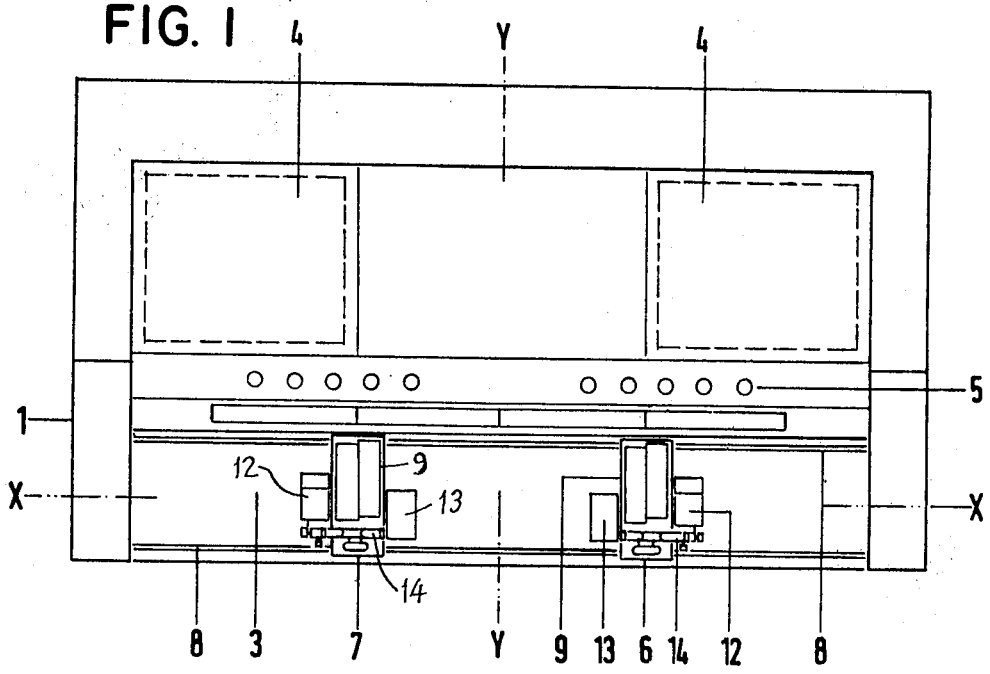
FIG. 1 is a top plan view of a playing board according to a preferred embodiment of the invention, parts being shown somewhat schematically or diagrammatically.
Figure 2:
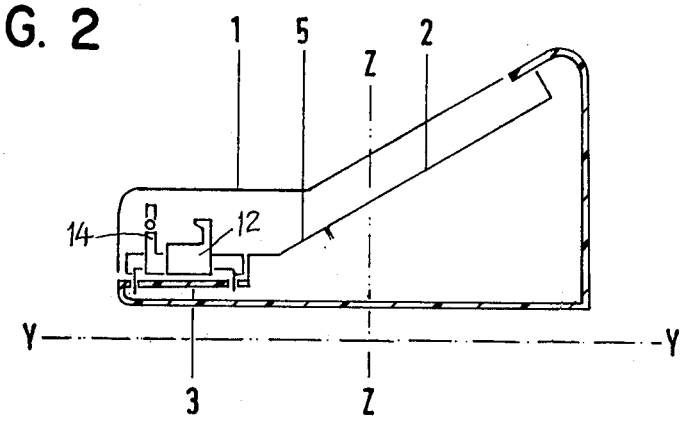
FIG. 2 is a schematic or diagrammatic cross section through the same.

Referring now to FIGS. 1 and 2, showing general and somewhat schematic views of apparatus according to a preferred embodiment of the invention, the apparatus comprises what may be called a playing board or control board indicated in general at 1, having a desk or table portion 2 and a channel or guideway 3, extending in the direction of the $x$-axis, that is, right and left with respect to a player sitting in playing position in front of the desk, in much the same way that one would sit on front of a conventional piano keyboard. The $x$-axis, running right and left, and the $y$-axis, running front and back perpendicular to the $x$-axis, are indicated schematically in FIG. 1, while the $y$-axis and the vertical or $z$-axis are indicated schematically in FIG. 2.

The desk 2 has surfaces or areas for the arranging of registries indicated schematically at 4. The action converters of these registries can be operated in the usual way as electric switches, or as slide controllers or turn controllers. Moreover, the desk 2 has surfaces for mounting electronic indicator appliances indicated schematically at 5. These indicator appliances give a visual indication of the sound bases and playing bases, when the instrument is being played, enabling the player to see at a glance various operating conditions or states.

There are two manuals, a right hand manual and a left hand manual indicated in general at 6 and 7, respectively, in FIG. 1, many further details of the right hand manual being shown in FIGS. 3–7. The left hand manual may be a reverse duplicate (reversed right to left) of the right hand manual. Both manuals are mounted on the guideway or track 3, for sliding movement leftwardly and rightwardly, along the $x$-axis. A portion of the track or guideway along which these manuals move is indicated at 8.

Figure 3:
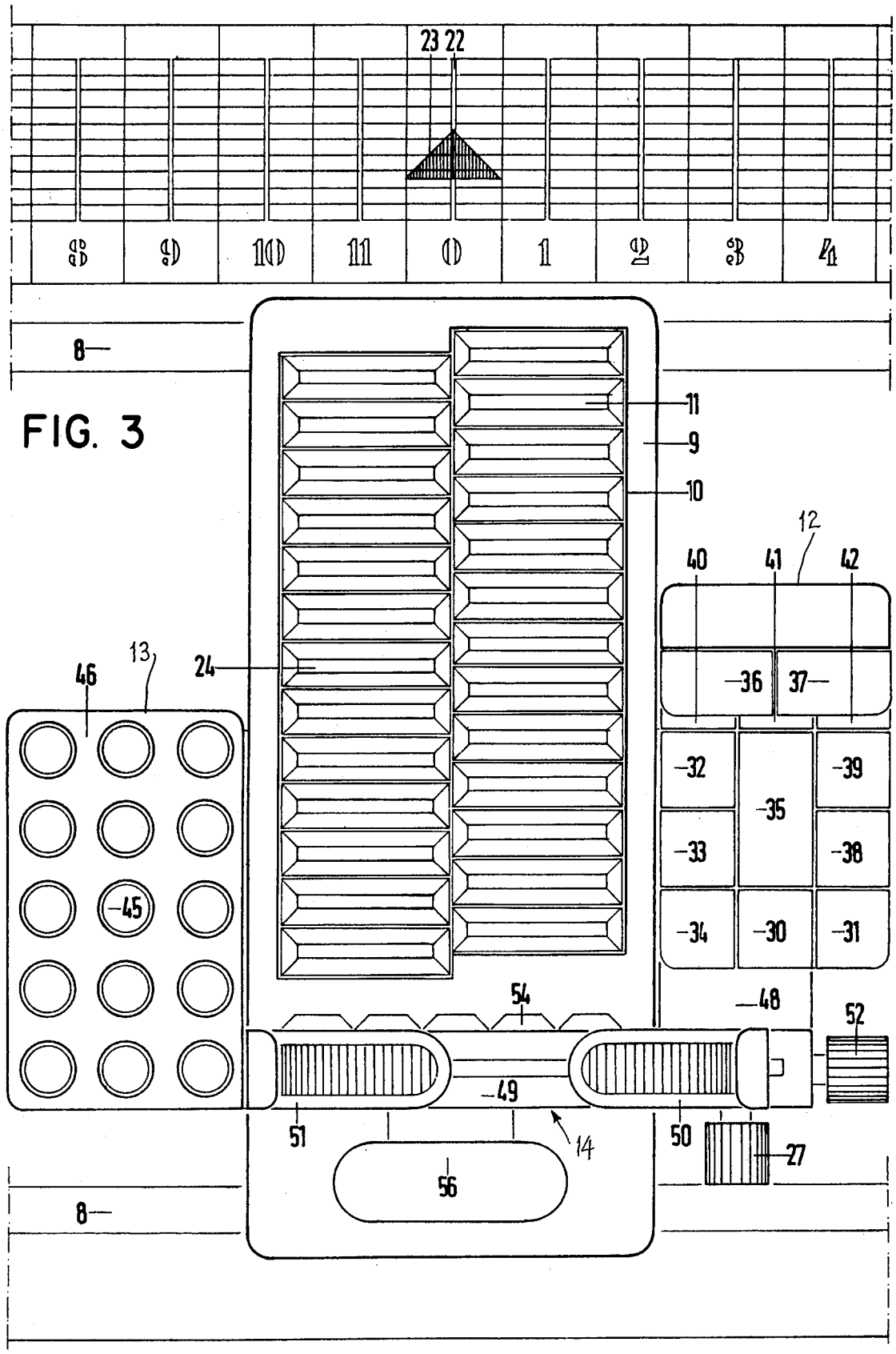
FIG. 3 is a top plan view of the right hand manual forming part of FIG. 1, but on a much larger scale.

Each of these manuals 6 and 7 has a basic frame unit 9 (FIGS. 3–5) supported by carrying frame members 16 (FIG. 4) having roller or slide elements 18 which travel along the track sections 19 and so arranged that, by only slight pressure, each manual may be moved rightwardly or leftwardly along the $x$-axis. The manual includes a keyboard indicated in general at 10 (FIG. 3) on which the main keys 11 of the console or manual are arranged. To the right of this main keyboard 10, in the right hand manual (or to the left of it, in the left hand manual) is a supplementary keyboard or console 12 (FIGS. 1 and 3)

containing special keys 30–42 further described below, these keys being in such position that they may be actuated by the little finger of the right hand, when the forefinger, middle finger, and ring finger are operating the main keys 11. Just to the left of the main keyboard 11 of the right hand manual (or to the right of the main keyboard, in the left hand manual) there is another supplementary keyboard 13 (FIGS. 1, 3, and 5) containing special keys 45, further described below, arranged in position to be actuated by the thumb of the player while his forefinger, middle finger, and ring finger are operating the main keys 11.

Also, both the right hand manual and the left hand manual include, near the front edge thereof (that is, the edge closest to the player) what may be called a trestle unit or supporting unit indicated in general at 14 (FIG. 1) and mounted to travel forwardly and rearwardly, along the *y*-axis, in straddling relation to the frame 9, keyboard 10, and main keys 11. This travel in the *y*-axis direction is accomplished by tracks or rails 20 (FIG. 6) and cooperating rollers or slide members 21. The trestle 14 is firmly connected to and serves to support the little finger console 12 and the thumb console 13, so that if the trestle 14 is moved in the *y*-axis direction, rearwardly or frontwardly with relation to the main keys 11, the little finger console 12 and thumb console 13 travel with it. Thus if the hand is rested upon the trestle unit, the hand and with it the unit may be moved rearwardly and forwardly, away from or toward the player, so that his forefinger, middle finger, and ring finger may reach any desired ones of the main keys 11, but at all times the little finger console 12 and the thumb console 13 will remain in proper position to be reached and operated by his little finger and thumb, respectively. In other words, putting it another way, the entire manual, including the main console 10, and the supplementary consoles 12 and 13, is movable relative to the desk in a right and left direction, along the *x*-axis, and in addition to this the supplementary consoles 12 and 13 and the supporting trestle 14 may also move rearwardly and forwardly along the *y*-axis, relative to the main console keyboard 10 which is stationary so far as the *y*-axis is concerned but movable only along the *x*-axis.

Figure 4:
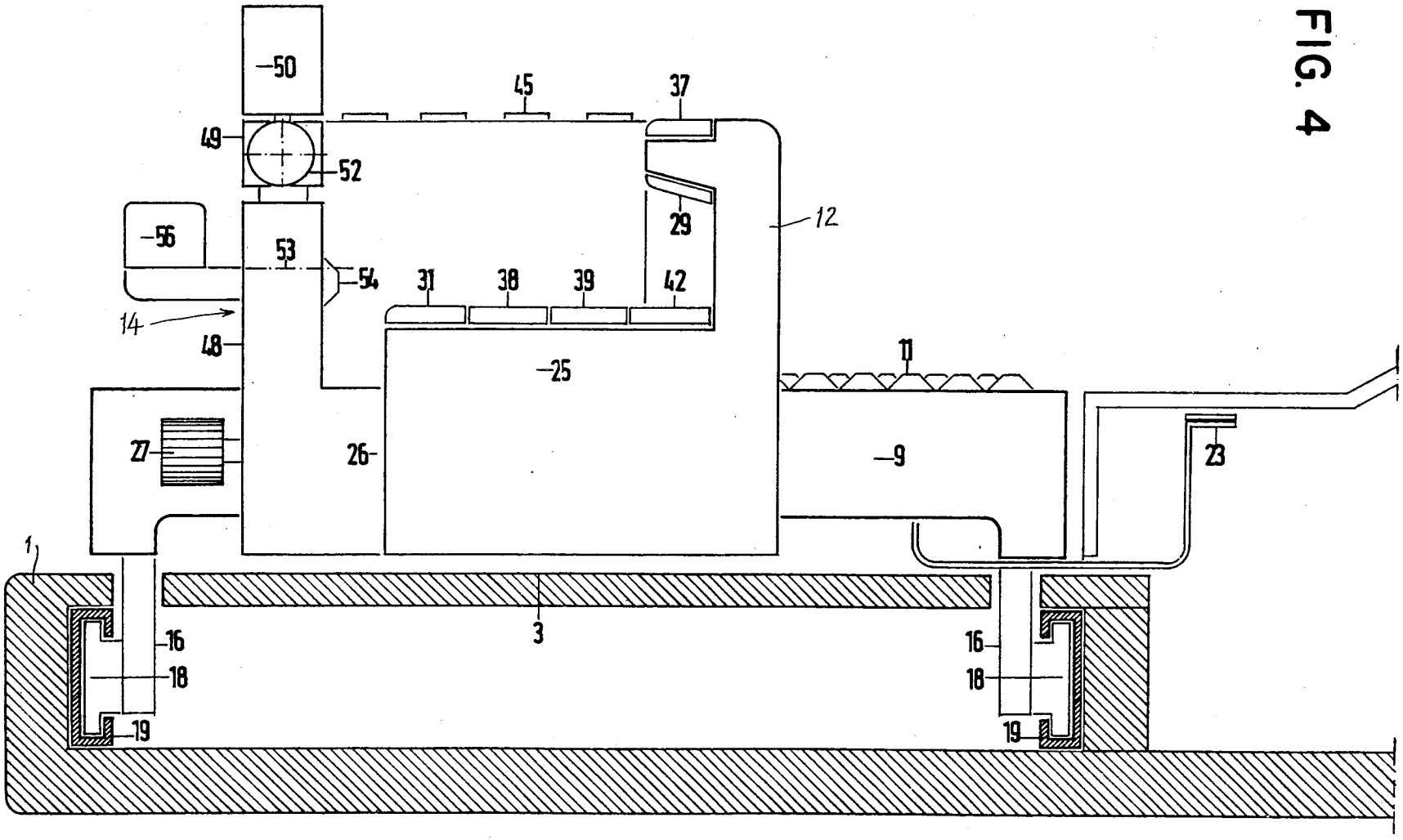
FIG. 4 is a view of the manual shown in FIG. 3, partly in right side elevation and partly in vertical section through the base.
Figure 5:
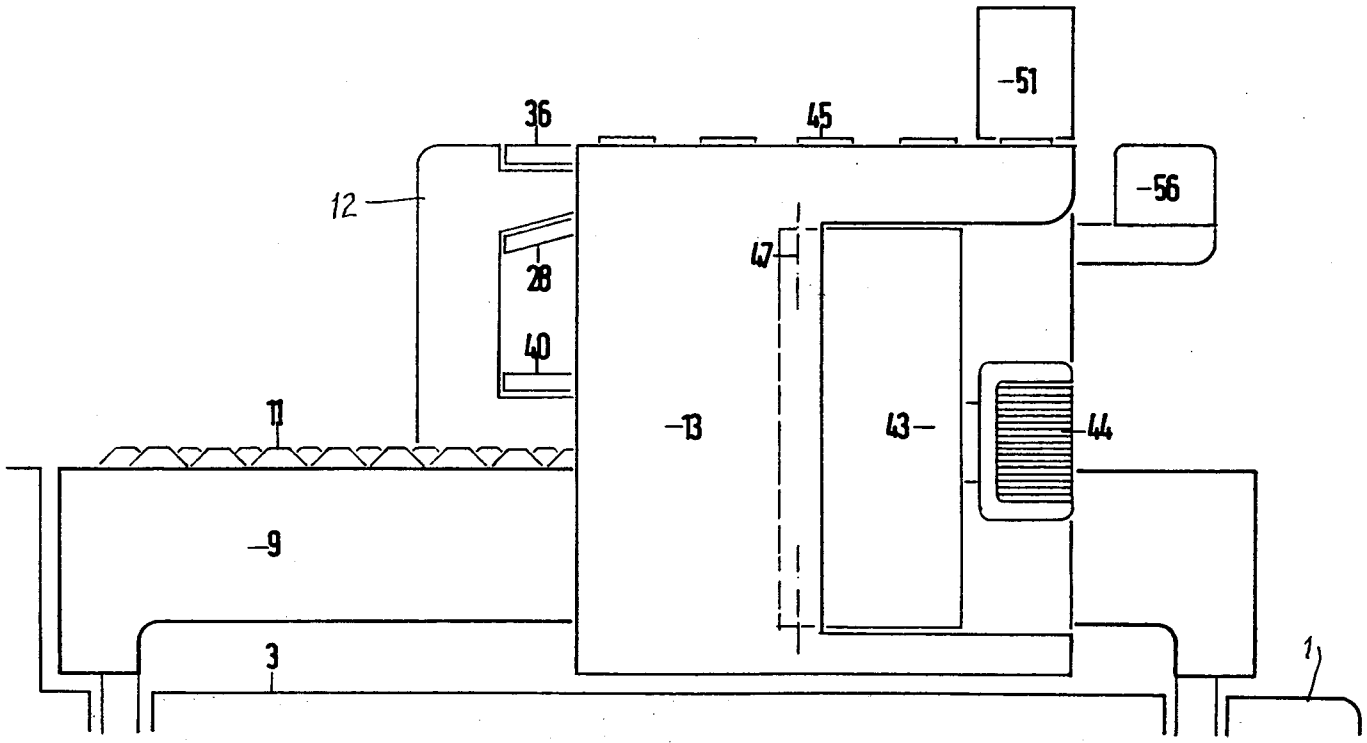
FIG. 5 is a left side elevation of the right hand manual shown in FIG. 3.

The trestle unit 14 and the supplementary consoles or keyboards 12 and 13, all connected together to move together as a unit as above stated, may be collectively referred to as the connection unit. As already mentioned, this unit straddles the main keys 11, so that the supplementary keys 30–42 and 45, as well as the rest portion of the trestle on which the hand or wrist rests, is at a higher elevation than that of the keys 11. In the case of the hand rest and the thumb operated keys 45, the elevation is considerably higher, as seen in FIGS. 4 and 5, but not too high for reaching the keys 11 by bending the fingers downwardly when the hand rests on the trestle. The little finger operated keys 31–42 are at an elevation just a little above the keys 11, as seen in FIG. 4, since the little finger is also bent downwardly to reach these.

As already stated, the electrical connections from the various keys to the electronic parts of the instrument, including the sound producing and modifying parts, may be of any conventional form. Because of the mobility of the keyboards relative to the stationary desk or playing board parts 1 and 2, the connections will naturally be either by flexible cables, or by sliding connections, whichever may be preferred by the designer of the electrical parts of the instrument. Such details are of no consequence so far as the present invention is concerned.

Preferably all these moving parts, that is, the left hand and right hand manuals themselves, which move bodily along the *x*-axis, and the connection unit which moves relative to the main keyboard along the *y*-axis, are all constructed of comparatively light materials, so as to have little inertia, thus being easily movable in the desired directions by gentle pressure exerted by the hand or arm of the player.

Figure 6:
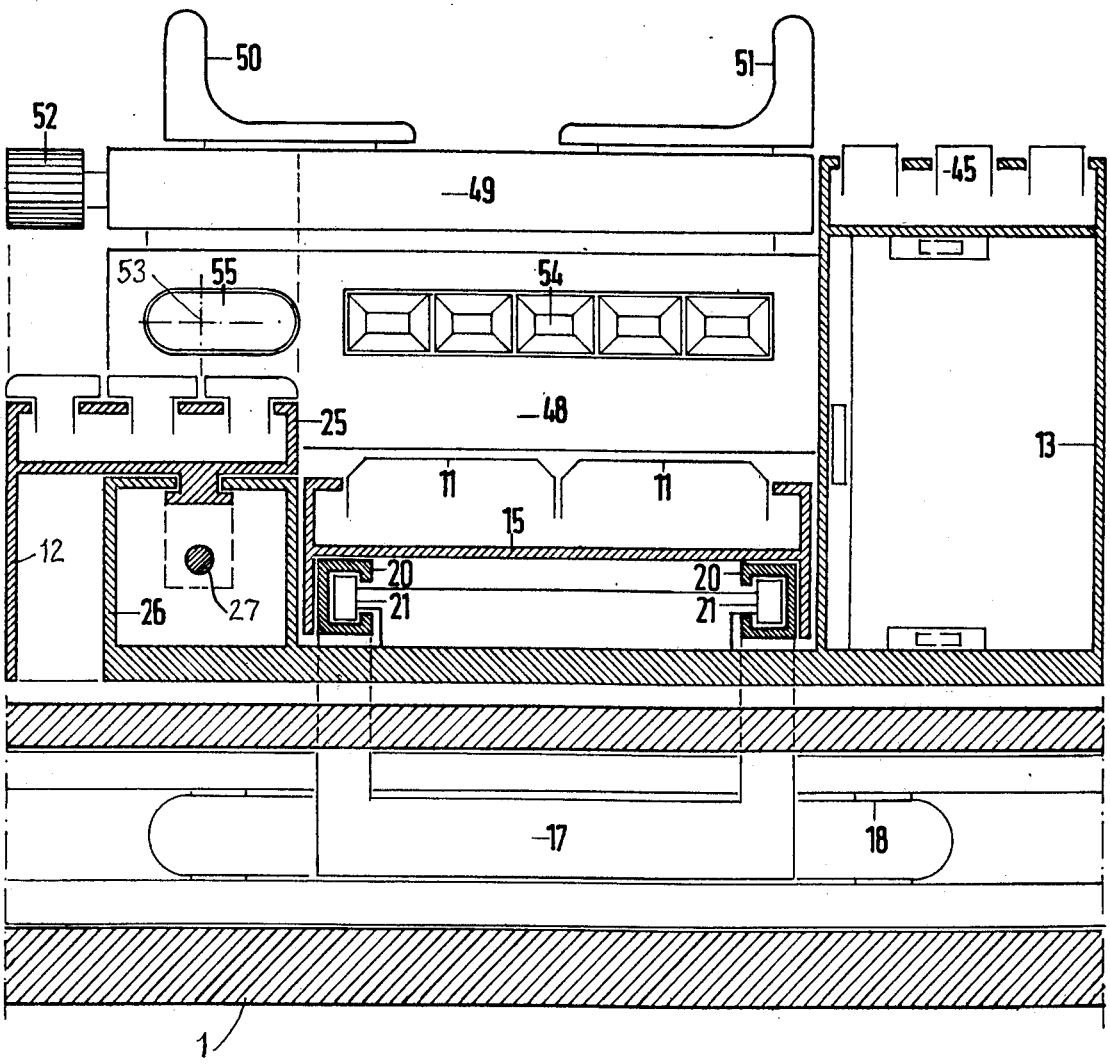
FIG. 6 is a front elevational view of the manual shown in FIG. 3, with parts in vertical section.

The frame unit 9 of the main keyboard 10 of each manual is formed basically from a flat rectangular box schematically indicated at 15 in FIG. 6.

Movement of the manuals 6 or 7 in the *x*-axis direction controls the single tones which are at the player's disposal within the pitch of the main keys 11. This means that the single tone notes produced by operating the main keys 11, which are in their tone degrees connected in a fixed interval relation determined by a special tone system, can be raised or lowered with regard to their pitch by changing the position of the frame unit 9 along the *x*-axis, without in any way changing the interval relations to the single tone notes among each other. Depending upon what electronic connections may be chosen, this control of pitch upon moving the manual right or left along the *x*-axis, may be an infinitely variable (that is, continuously variable) control, or may be in stages or steps. When the control is designed to be in stages or steps, the pitch is lowered or raised from one passage or line interval to the next, preferably by the interval step of one half note of the tempered tone system. The pitch keeps fixed within the interval step concerned, which can be called the fret or rod stop. If the control is designed to be continuous (without steps) the control is effective in a continuous manner over the entire controllable passage distance.

The total controllable passage (whether by steps or by continuous control) is appropriately divided into four octaves. The raising of the pitch can be fixed so as to run from left to right, in the conventional manner that the keys of a piano produce notes of successively higher pitch from left to right. Additionally, the total controllable passage is preferably extended by one fret on each of the left and right ends. Accordingly, such a controllable passage shows $4 \times 12 + 1 + 2 \times 1 = 51$ frets altogether. This means that the whole controllable passage line presents five different octave pitches. The normal position of both the right hand manual 6 and the left hand manual 7 is in each case in the fourth and second octave pitch. Both the manuals 6 and 7 can be controlled in the same or a different way, alternatively either by changing the pitch continuously, or in step stages.

At the rear part of the course or movement track of the manuals, fret markings 22 are provided, as indicated in FIG. 3, and they cooperate with an index mark 23 connected to and moving with the respective manual unit 9, so that the player can see at a glance the particular fret in which the manual is located at the moment. The conversion of the right and left movements of the manual along the fret scale can be converted into electrical control signals in any known way, such as by using rolling contact electric rheostates working continuously, or by degrees, arranged in the playing board 1 along the manual course 3.

The continuous variation change of pitch serves the purpose of pitch control of single tones or of whole chords. Thus free intonability, glissandi, and pitch vibrato, can be produced.

Changing the pitch by degrees or steps rather than continuously gives the player some help. Thus touch fingerings or sequences or specific chord touches can be kept over the entire 12 keys.

The main keys 11 that are located in one keyboard 10 are arranged in the case or box 15. They serve mainly the purpose of controlling single tones. For any one position of the keyboard 10 along the *x*-axis, the pitch produced by operating a particular key is determined by the position of that key in the group of keys. The relative tones assigned to the keys of the group may be in accordance with any desired tone system. Preferably the conventional tempered tone system is used. As well understood, this tone system divides an octave into twelve equal intervals, the vibration proportion of which is determined by the factor which is the square root of 12. The values assigned to the different keys could, of course, be based on any other desired tone system, for example, a more refined octave subdivided into more than 12 intervals, or a tone system of a non-European kind.

Because of the desire to keep the mass and inertia of the manual as low as possible so as to promote easy and quick movement of the manual during playing, the number of main keys 11 is kept as small as possible. In order to provide complete presentation of all pitches of the tempered tone system, the total tone volume of the keyboard 10 must not be smaller than one octave. However, in order to permit a technically simple presentation of single tone sequences and chords, it is desirable to keep the tone volume considerably large than one octave. As a compromise of these two conflicting requirements, the tone scale of the keyboard 10 in the preferred embodiment of the present invention is fixed at a little more than two octaves. The totality of all pitches or tone degrees represented on the keyboard 10 can be referred to as the set of pitches or tone degrees. The pitches are designed in steps in the *y* direction as their main direction, which means that the main movement direction of the fingers of the player in locating particular pitches runs in the *y* direction. The ascending pitches preferably run from front to back; that is, the lower pitches are produced by the keys closer to the player, and successively higher pitches by keys further rearwardly away from the player.

The main keys 11 are, as usual, kept in a neutral position (at their upper limit of upward and downward travel) by suitable springs. The keys are designed in a narrow rectangular ground-plan shape. The top surface of each key, for the purpose of better and more secure touch, has the shape of the frustum of a pyramid. Each key is elongated in the *x* direction, and relatively narrow in the *y* direction. The elongation in the *x* direction is of such dimensions that two fingers of the player's hand can play the same key 11 side by side. In that way the repetition of a touch and thus the presentation of fast rhythmic figures can be achieved easily.

The main keys 11 are preferably divided into two lines or groups extending in the *y* direction, as readily seen in FIG. 3. These two lines are appropriately transposed or offset from each other in the *y* direction by one-half the breadth (front to back) of one main key. In each line of keys, successive keys represent successive whole notes. One line is offset relative to the other, however, by one-half a note. By this arrangement, the several well known scales can be presented in a playing-technically simple form.

All of the main keys 11 cannot be reached by the fingers of the player's hand from any one position of the hand. Therefore, as already briefly mentioned above and as now emphasized, the hand is placed on the trestle or support unit 14, and this trestle unit is moved in the *y* direction, toward or away from the player, as may be necessary to enable his first finger, middle finger, and ring finger to reach whichever ones of the main keys 11 he may desire to reach at any given moment. The track for moving the connection unit (trestle and associated parts) is lengthened in a forward direction sufficiently so that the fingers of the player can reach the first keys 11, closest to the player, when desired.

As the keyboard 10, when located in any one position along the *x*-axis, covers only a very limited tone scale, and whereas the whole unlimited tone scale is meant to be playable on this musical instrument, the transposing of the set of pitches from a range determined by one particular position of the manual to a different range, must be possible in a simple way. The following controlling possibilities are provided for this purpose.

At the outset, the player must determine in which set of pitch ranges both the right hand manual 6 and the left hand manual 7 will have to be, when beginning to play. The range of pitches for the two manuals will normally be in different octave ranges. The chosen range of pitches for each manual can then be fixed by the pressing a special key which, through the known electronic circuitry (not here disclosed) determines the initial pitch range for each of the two manuals. Moreoever, the position of the set of pitches in its relation to one of the 12 pitches of the tempered tone system will have to be determined. This chosen pitch may be called a basic or normal tone. Any desired one of the twelve pitches or tone degrees of the tempered tone system can be chosen and fixed as the basic tone, by pressing a special key that works to set the basic tone. As before, this is done through conventional electronic circuitry. The chosen basic tone is fixed by setting on certain main keys 11. The set of pitches thus fixed can be called the basic or normal set of pitches. When the basic tone has been chosen and fixed in each case, it causes the lighting up of an appropriate indicator light in the indicator line 5 (FIG. 1) one light indicating the chosen basic tone for the right hand manual and another light the basic tone for the left hand manual.

When playing, it may happen that a transgression or a remaining-under of the pitch with regard to the set of pitches fixed on the keyboard 10 is necessary. Without any delay, the set of pitches can be transposed upwardly or downwardly by one octave by pressing either one of two special keys, one for upward transposition by one octave, the other for downward transposition. In addition, or as an alternative to such special keys, this transposition may be accomplished by moving the manual relative to the desk in the *x* direction thereby operating rheostates located in the case 7 to cause the desired transposition.

If the scales of single tones are to be represented in a fast sequence in large parts of the audible frequency range, the following special control may be used. The special mode of control can be set in operation by a special key. According to its mode of operation, the operation of this special key serves to automatically transpose the set of pitches upwardly or downwardly by a special electronic circuit arrangement, by that interval step which the main key 11, being last pressed and then let go, forms to a related main key 24. Each of the twelve pitches of the tempered tone system, and with this each interval step, can be selected upward or downward from this related main key 24. The special mode of control operates as long as the respective special key is pressed and held. After discontinuing pressure on this special key, the basic or normal set of pitches on the keyboard 10 is fixed again, in the meanwhile reached octave range, however. This special mode of control can be called interval transposition.

The fixed pitch in each case being fixed on the related main key, is indicated on one of the indicator appliances 5, serving as a visual check. By means of this interval transposition operation, very fast sequences of notes can be played in a rather simple form of playing technique, over the whole range of audible frequencies. As usual, the commencement, the duration, and the muting of a single note or sound are controlled by pressing a main key 11 against a retaining spring, and by letting it go. As usual, the control contact is reached only when the pressed main key 11 has been depressed sufficiently through its range of travel, called the key lift.

The main keys 11 are played with the most productive fingers, that is, the digital or first finger, the middle finger, and the ring finger. In the normal case, therefore, chords of three notes or voices may be played on both of the manuals 6 and 7. In exceptional cases, the little finger can also be used, to play chords of four notes on one or both of the manuals 6 and 7. In the case of interval transposition, however, the keyboard 10 is playable only in mono, that is, single tones rather than chords.

According to another aspect of the invention, a special mode of control is applicable as a playing help for easy control when it is desired to repeat instantly either the same note or the same chord or sound. This special mode of control is put into operation when desired by special keys. After the commencement and duration of a sound signal controlled by pressing and letting loose the appropriate main key or keys 11, the same sound signal with the same intensity and duration is repeated once or several times by means of a special electronic circuit, if the special key controlling this mode of operation has been pressed. As already mentioned above in connection with other modes of operation, it is not attempted here to disclose any particular electronic circuit for doing this, but the provision of such a circuit is believed to be within the skill of a skilled worker in this field, once the desired result has been stated, as here. If desired, the electronic circuitry for this special mode of operation need not repeat the note or sound with the same duration in which it was originally played, but can be made to repeat it with either longer or shorter duration. Likewise the interval between the termination of the sound originally played and the commencement of the repetition can be appropriately varied. The frequency of repetition of the originally played sound, whether to be repeated only once, or twice, or three times, or more, may also be controlled by adjusted, under the control of a appropriate special keys. Similarly the volume may be controlled or adjusted by special keys, so that the repetition of the originally played note is at the same volume or a greater volume or a smaller volume or loudness than when it was originally played.

According to another aspect of the invention, an important special circuit, put into operation by pressing a special key, is to be provided for improved control for muting the sound signal. According to this, the muting which normally takes place when letting go (releasing downward pressure on) the main keys 11, is interrupted so that the sound signal keeps on sounding without being muted, as long as the special key is held down. Then when the special key is released, the normal muting or sound termination operation is effective again.

With this special circuit for interrupting the muting, the sound slurring of different tones and sounds can be arranged in an easily playable way.

The musical stress or accent of a tone or sound can be varied with regard to its volume and/or its timbre. The control of such stress may be practiced by use of the main keys 11, whereby the volume and/or timbre of the tone or sound can be controlled continuously (without degree or steps) by using a more or less hard acceleration of the main key 11, when it is pressed, or by a more or less hard pressing of the key at the bottom of its range of downward travel. Electronic means for controlling this, in response to the degree of downward acceleration of the movement of the key and/or in response to the degree of pressure exerted at the bottom of the downward stroke of the key, are known in the art.

The striking or production of tones can be musically designed by means of representing an additional sound at the entry or commencement phase of a note. This additional sound can be called the entry sound. The use of such entry sounds is controlled also be the main keys 11.

Another control possibility of the main keys 11 is the use of these keys for the selection of certain timbres and/or curves employing amplitudes of tones or sounds. The keyboard 10 can be switched over in such a way that, by pressing the main keys 11, specific timbres and/or curves enveloping amplitudes of tones or sounds can be pre-selected. By arranging the keyboard 10 in this way, the keyboard assumes a task that is usually realized by the registry. Because of this possibility to switch over the keyboard 10, a quick change of selected timbres and/or curves enveloping amplitudes is practicable while playing, without having to move the players hand far away.

Another control possibility of the main keys 11 is that, after switching off the set of pitches and an additional switching on of a set of different sounds on the keyboard 10 at the same time, the entry and, if necessary, the duration and muting of sounds can be controlled by pressing the main keys 11. One can handle the additional switching-on in the same way as the selection of timbres.

The supplementary or additional console 12 (FIGS. 1 and 3) is preferably designed as a tray 25 (FIG. 4) which carries special keys in three planes or levels. This tray 25 is supported on the support 26, which forms part of the connection unit, but is adjustable forwardly and rearwardly (in the direction of the *y*-axis) with respect to the support 26, by means of an adjusting screw 27, for the purpose of placing the special keys on the tray 25 in proper position to place the special keys within the differing action ranges of the small fingers of the hands of different players. The special keys on this tray 25 preferably work in the mode of switches. They can, during playing, be controlled by the small finger of the player, to cause switch-over of the keyboard 10, transposition of pitch sets, switching on and switching off of playing supports and sound shapings. In this connection, the position, assignment, and design of the special keys is chosen in such a way as to facilitate the easy touching and operation, by the little finger of the player's hand, not only of individual special keys, but also of two or more keys at once, whenever desirable.

The various special keys carried by the tray 25 include the following: two special keys 28 (FIG. 5) and 29 (FIG. 4) for octave transposition. Both of these preferably work as touch switches, which means that when one of them is touched by the nail of the little finger, the set of pitches is transposed upward or downward, as the case may be, by one octave. The special key 30 is provided for interval transposition. This is preferably a permanent touched key, which means that pressure on the key must be continued as long as the interval transposition is desired, and the normal operation is resumed when pressure is released.

The special key 31 is for presentation of pitches in a refined subdivision of the octave. This is preferably a permanent touched key, which means that pressure on the key must be so long as the refined subdivision (to a greater number of increments) is desired. Upon pressing and holding this key, the octave may be subdivided into 48 or 24 equal intervals. After letting go the special key 31, the normal set of pitch intervals is resumed on the keyboard 10.

The special keys for control of automatic repetition of the note or chord are indicated at 32, 33, and 34 in FIG. 3. The special keys preferably work as permanent touch keys, being effective only while pressure on the key is maintained. A single pressure on any of these keys repeats the sound once. When a harder pressure is maintained on one of these keys, the sound signal continues to be repeated rhythmically until the pressure on the key is released.

Various repetition arrangements can be assigned to these special keys. For example, the special key 32 may, through its connected electronic circuitry, serve to repeat the same note twice, the first repetition being slightly held and the second repetition being of shorter duration. The key 33 may serve to repeat the previously played note twice, with the same duration each time. The key 34 may, for example, be assigned to repeat the previously played note four times, each with the same duration. A repetition of the previously played note twice, with the first repetition being of shorter duration and the second repetition being longer, can be produced by simultaneously touching both of the special keys 32 and 33. The repetition of the note three times with equal duration can be done by simultaneously touching both of the special keys 33 and 34.

The special key 35 (FIG. 3) working by permanent touch (effective only so long as pressure is maintained) controls the electronic circuit which interrupts the mutings or termination of the note or sound. The same note or sound played by depression of one or more of the main keys 11, continues to be sounded so long as pressure on the key 35 is maintained, and is muted or stopped when pressure on the key 35 is released.

The special keys 36 and 37 (FIG. 3) which are preferably at a higher level or elevation on a higher part at the rear of the tray 25 (see FIG. 4) are for the control of the entry curve of the sound. They are preferably momentary touch keys, on which pressure does not need to be maintained. By means of these keys, three different entry curves can be chosen. By operating key 36, a flat entry curve for the sound is chosen; by touching special key 37, a steep entry curve for the sound is chosen; and by simultaneously touching both of the keys 36 and 37, a medium entry curve is produced.

The special keys 38 and 39, which are on the main lower level of keys rather on the elevated rear part of the tray 25, serve to control the shape of the exit curve of the tones or sounds, that is, the manner in which the sounds terminate. These preferably operate on the permanent touch principal, requiring to be held so long as the operation controlled by the key is desired. The exit curve or curve of decay of the sound can be chosen as desired. The basic exit curve or decay curve of the tone, percussion tone, and permanent tone, can be changed by touching and holding the special key 38, in accordance with which the basic exit behavior is fixed on the keyboard 10. If a percussion tone is fixed on the keyboard 10, the keyboard is switched to a permanent tone by touching and holding the special key 38, and vice versa. After letting go the special key 38, the exit behavoir originally fixed on the keyboard 10 is again operative. Thus it is possible to change the basic exit behavior or decay curve during playing without any loss of time. Upon touching and holding the special key 39, at the moment of letting go of a main key 11 which has produced a certain tone, this tone is muted steeeply down to zero. The normal short resounding or sustaining of the tone after letting loose of one main key 11 does not take place while this key 39 is held. After letting up the special key 39, the normal short resounding time becomes operative again. A short staccato can thus be represented when playing with the keys 11 while holding the special key 39 down.

Special keys 40, 41, and 42 (FIG. 3) are on the lower or main level of the keys of the tray 25, somewhat under the overhang on which the keys 29 and 37 are mounted, as seen in FIG. 4. These keys serve to control a choice of artificial reverberation. Preferably they are keys working on the short touch or momentary touch principle, as distinguished from permanant touch keys. That is, they do not have to be held. These keys control different reverberation or resounding durations and/or intensities. By briefly touching the special key 40, a reverberation or resounding duration of zero can be chosen. The special key 41 sets the circuitry for medium sound duration. The special key 42 sets it for a long or sustaining sound duration. When simultaneously touching two neighboring special keys, 40 and 41, or 41 and 42, corresponding intermediate values of duration can be chosen. Whatever sound duration is chosen by these keys remains in effect during the remainder of the playing, until a different condition is chosen. The different resounding values can be used to accommodate or adjust the playing to different rooms with different acoustical conditions, as well as to adjust it when a different or replaced sound element is used.

The special key 30 for interval transposition and the special key 31 for subdividing the octave are preferably provided only on the manual which is considered the main or master manual. That is, when the instrument is designed for a right handed player, the right hand manual 6 is the main or master manual, and these special keys 30 and 31 will be provided on that manual but will be omitted from the left hand manual 7. Conversely, if the instrument is designed for a left handed player, the left hand manual 7 will be the main or master manual and will contain these special keys, which can then be omitted from the other manual 6.

The supplementary console 13, containing the special and additional keys in the action range of the thumb, is preferably designed in such a manner that the special keys 43 and 44 (FIGS. 5 and 7) are arranged in close proximity to the trestle unit 14. The additional special keys 45 which may be operated by the thumb but which may also be operated, if desired, by the first finger or middle finger, are arranged on the top surface 46 of the tray-like supplementary console 13.

The special keys 43 and 44 operated by the thumb are used for control of the sound elements either in a continuous manner or, if preferred, by degrees or steps. They serve to control the timbre changes of the tones.

The continuous control of the sound elements in the phase of the tone entry aims to render the entry of tones during the playing in such a way that entry sounds receive a shape character similar to the shape character of consonants in human speech or in singing. The special key 43 for control of sound elements is preferably designed as a turn-wing held by a spring, which turns on a vertical axis pointing in the *z* direction. If desired, this special key 43 may alternatively be shaped as a sliding key, movable in the direction of the *y*-axis. By turning this key 43 (if it is mounted for oscilation) or by sliding it (if it is of the sliding type) the volume can be controlled from zero to maximum and/or the sound character of the consonant noice or sound can be controlled from smooth to hard. The changes in the control action may be fed into the corresponding electronic circuits through an electrical adjustment resistor.

The purpose of continuously controlling the formants or other changes or timbre during the whole duration of a note is to render the timbre of tones during the playing designable in such a way that these timbre changes receive a shape character similar to the shape character of vocals in human speech or in singing. The special key 44 is preferably provided for the control of formants, and is preferably designed as a sliding key, easily slidable in the *z* direction or vertical direction on the console 13. In a variant form, the sliding key can be mounted to slide on the turn-wing of the special key 43, instead of mounting the key 44 directly on the console 13. By sliding this special key 44, the formants can be continuously changed in such a way that for instance a timbre change occurs similar to the vocal line *u-o-a-e-i*. The change of the control actions can be rendered in a simple way over an electric adjustment resistor.

Since the control motion of the special key 43 is mainly in a *y* direction and the control motion of the special key 44 is in the *z* direction, both of these special keys 43 and 44 can be easily controlled with the thumb, largely independently of each other.

The additional special keys 45 arranged on the top surface 46 of the console 13 are designed as switches, and during the playing, they render possible different switch-overs by pressure of the player's thumb or first finger or middle finger, without appreciably handicapping the flow of the playing. In the first line action converters can be switched on or off with the special keys 45. Moreover, by one or another of these special keys 45, the continuous or fixed value mode of operation of action converters can be fixed, and additional switch-overs of the keyboard 10 are practicable with them when chosing timbres and/or curve enveloping amplitudes.

Turning now to the trestle unit 14, this comprises a base part 48 (FIGS. 3, 4, 6, and 7) on which is mounted an upwardly and downwardly swinging or oscillating arm 49, which arm carries clamp jaws 50 and 51. These jaws 50 and 51 engage the side edges of the player's hand which is placed palm downward between these jaws. They can be moved longitudinally along the axis of the oscillating arm 49, to accommodate hands of different widths, by an adjusting screw 52. In addition, the clamp jaws 50 is designed as a special switch key. If there is no hand resting on this jaw 50, it is slightly raised relative to the oscillating arm 49 on which it is mounted, by a suitable spring, and operates a switch in the electrical circuitry in such a way that the keyboard 10 is switched over so that timbres and/or curves enveloping amplitudes are chosen with the main keys 11. When the weight of a hand rests on this member 50, it is slightly depressed relative to the member 49 to change the switching so that the set of pitches is additionally switched on the keyboard 10 at the same time. Thus in a simple manner a switch over of the characteristics produced the keyboard 10 can be achieved without the necessity of using the person's fingers.

Figure 7:
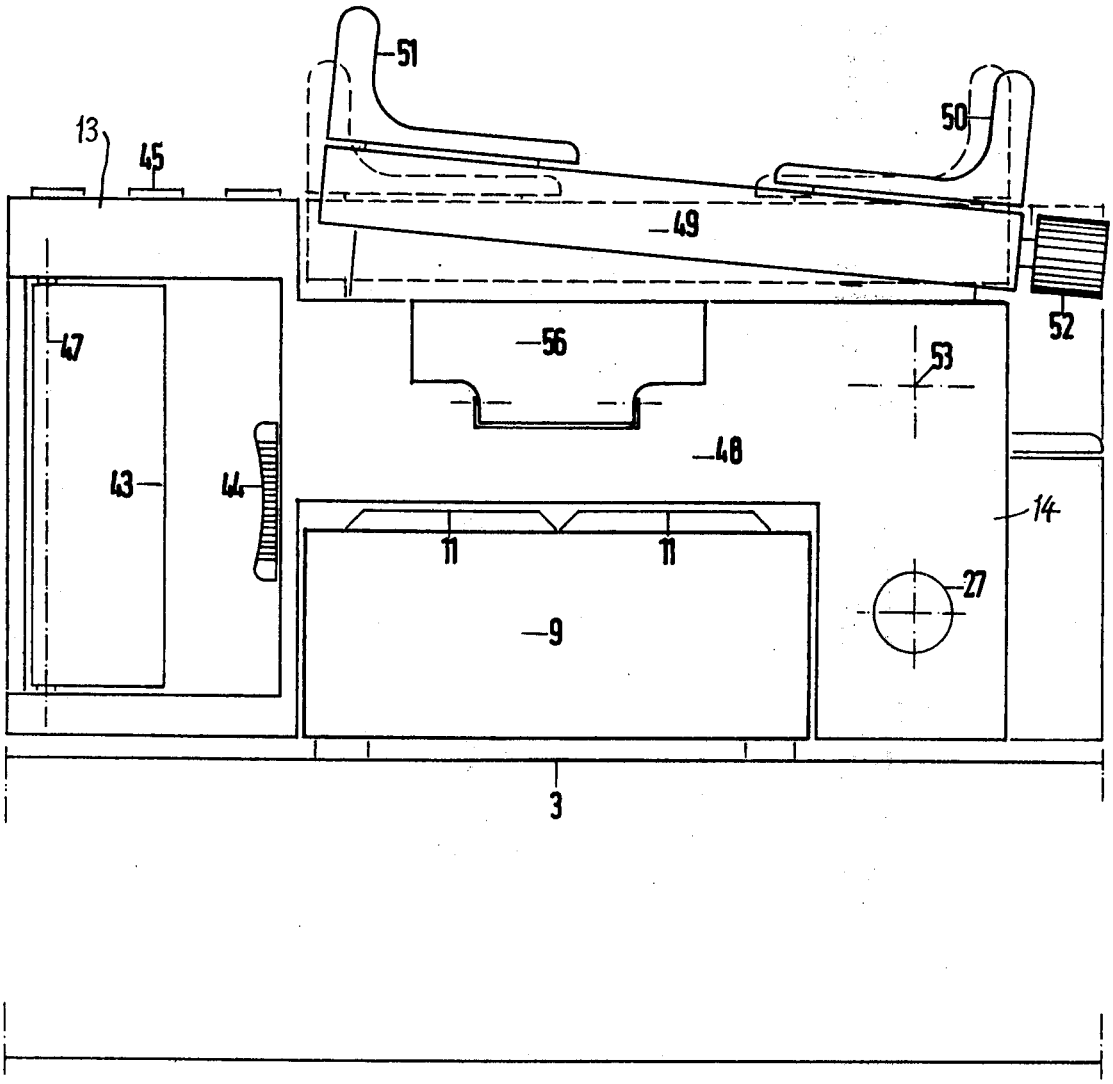
FIG. 7 is a rear elevational view of the same.

The osciallating arm 49, which carries the clamping members 50 and 51, is arranged for a limited degree of upward and downward oscillation about an axis extending in the *y* direction. This axis of oscillation is schematically indicated at 53 in FIG. 7. A spring (not shown) tends to elevate the arm 49 to its upward limit of travel, which is illustrated in FIG. 7, where the arm 49 is slightly tilted upward. When a hand rests on the arm 49 (or on the clamping members 50 and 51 mounted on this arm) and presses downwardly thereon, the arm 49 moves downward to a substantially horizontal position as shown in FIG. 6. The arm may be moved to an intermediate position between its upward and downward limits, by appropriately varying the downward pressure produced by hand of the player.

This upward and downward singing movement of the arm 49 is used for controlling the volume of output of the sound. When no downward pressure is employed, so that the arm 49 is at its upward limit of travel, the output of the volume of sound is zero. When it is fully pressed down to its lower position, the maximum volume of sound is produced. This is done through any convenient known form of electronic circuitry, such as variable resistor having a slider or movable element controlled by the upward and downward swinging of the bar or arm 49. The continuous changeability or adjustment of the volume of sound by means of the oscillating arm 49 serves for sensitive or subtle control of the tone signals during the whole duration of the playing. Thus different processes of swinging in and out and the volume vibrato can be accomplished.

The switch like working special keys for the selection of the octave range are the keys 54 (FIGS. 3 and 6) and are installed on the rear side of the trestle base portion 48, that is, the side facing toward the main keys 11. The octave range can be chosen and can be fixed for the subsequent playing or pressing one or another of the special keys 54, either with the first finger, the middle finger, the ring finger, or the little finger. Five special keys 54, as illustrated in FIG. 6, are normally sufficient to be able to fix the desired octave range.

The special key 55 (FIG. 6) for fixing or determining the normal tone is also on the rear face of the base part 48, facing toward the main keys 11, and is in a location, as seen in FIG. 6, which is appropriate for operation by the little finger of the player. There are two ways of fixing the normal tone. First, a pitch can be chosen on the main keys 11 and simultaneously the special key 55 can be pressed. By doing this, through the appropriate electronic circuitry, this pitch is chosen as the normal tone and fixed for the subsequent part of playing, until again changed. Second, both of the manuals 6 and 7 can be moved toward the fret stop of an equal pitch. By pressing special key 55, this pitch is chosen as the normal tone and fixed for subsequent playing.

On the forward side of the base 48 of the trestle structure, closest to the position of the player when playing, there is a coupling plate 56 (FIGS. 3 and 7) which, when pressed with the ball of the thumb, through suitable mechanical means of power transmission, will grasp the slider or movable part of an electric regulating resistor (adjustable resistor) and move it when the connection unit is moved. In this way, the electrical regulating resistor is adjusted, to serve to control the medium volume of sound produced by playing the keys of the manual 6 or 7, thus changing the range of volume which is regulated by the oscillation of the arm 49. When the index mark 23 is moved along by movement of the manual in the *x*-direction, this may serve also to indicate the adjusted position of the regulating resistor. The continuous changeability of the medium volume serves to harmonize the volume of both the manuals 6 and 7 mutually, and to represent dynamic developments and crescendi while playing.

Since all continuous control functions of both manuals 6 and 7 can be fixed on certain values by the additional special keys 45, or by the registry's registry-keys can be completely switched off, it follows that the playing technique for playing the instrument can be easily changed and adjusted to the qualifications of the particular player. Thus there will not be any overstress. Moreover, the presentation of sound patterns of certain historic musical instruments can be facilitated by the fixing on of fixed or predetermined values.

The advantages achieved by this invention include, among others, the fact that an efficient manual playing device is coordinated to the output of a largely unlimited working sound basis. Thus the basic sound performance possibilities of such a sound basis can be direct control be utilized to the largest extent. A great number of different sound elements can be controlled and represented in a parallel manner. Especially the multitute of continuous control possibilities makes possible a sensitive sound presenation, which can surpass to a large extent the sound pattern of known musical instruments. The sound patterns of historic musical instruments can largely be imitated and substituted. Presentation of new and musically valuable sounds can be expected in view of the multitude of control possibilities. A clear channel formation without any dependence on or loading of other effector-groups is achieved by the high utilization of the controllability of all effector-groups of one hand or both hands.

Figure 8:
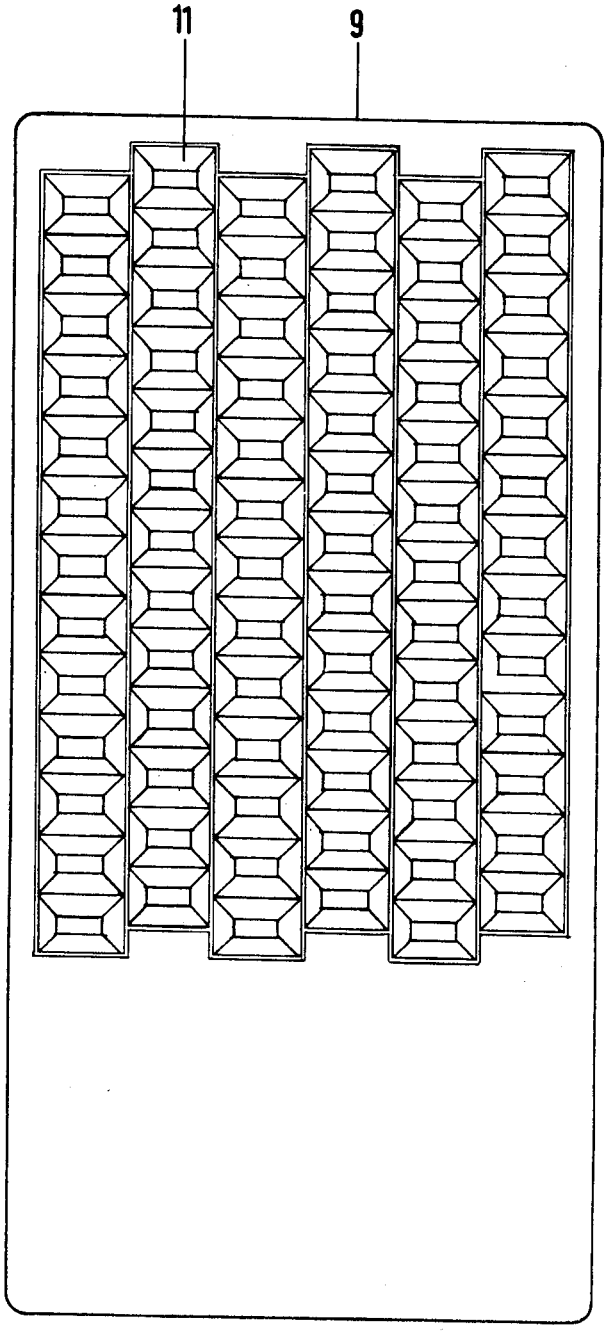
FIG. 8 is a plan view similar to a portion of FIG. 3, showing an alternative arrangement of the main keys.

In FIG. 8 there is shown an alternative arrangement of the main keys 11. In the first embodiment (FIG. 3) the main keys 11 are arranged in two rows, the keys of each row being long enough in the *x* direction so that two fingers at a time may be placed on each key. In the alternative or modified arrangement of FIG. 8, these keys 11 are arranged in six rows instead of two rows, each key being only long enough in the *x* direction for one finger.

As before, the rows of keys run in the *y* direction, that is, toward and away from the player rather than from side to side as in a conventional piano keyboard. Moreover, the adjacent rows are staggered with respect to each other, in the *y* direction, through the space or distance of half a key, as readily seen in FIG. 8.

The first and second row (counting from the left) are positioned for actuation by the first finger or forefinger. The third and fourth rows are positioned for playing by the middle finger. The fifth and sixth rows are positioned for playing by the ring finger. This is with relation to the right hand manual. In the left hand manual, this would be reversed, of course, the fifth and sixth rows being for the first finger, and the two rows at the left being for the ring finger. In this alternative arrangement, the full tone scale represented by the two rows of keys in the first embodiment, is here represented three times by three double rows of keys.

These keys in this modified form may, if desired, be mounted as touch switches or sensors, each row being on one movable beam, so that six movable beams are used for the six lines of keys. When touching a main key, the corresponding pitch or tone degree will be chosen, and when pressing down the whole beam the entry or attack and especially the accent of the tone can be controlled. The advantages of this modified arrangement of the keys are that they enable a faster and easier fingering of single tone scales and especially of chords.

What is claimed is:

1. A device for playing an electronic musical instrument comprising (a) a fixed support, (b) at least one manual mounted on said support for movement thereon in a horizontal *x* direction from side to side with respect to a player seated in front of said support, (c) said manual including (i) a first console having a series of digitally operable main keys representing different tones and positioned for operation by the first finger, middle finger, and ring finger of a player's hand, (ii) a second console located on one side of said first console and having a plurality of special keys positioned for operation by the little finger of a player's hand, and (iii) a third console located on the opposite side of said first console and having a plurality of special keys positioned for operation by the thumb of a player's hand, and (iv) a trestle unit for supporting a player's hand in playing position with the thumb and fingers within reach of the respective keys on the respective consoles.

2. The invention of claim 1, wherein said main keys on said first console are arranged successively in a horizontal *y* direction from front to back, approximately perpendicular to said *x* direction of movement of said manual with respect to said fixed support.

3. The invention of claim 2, wherein said main keys are arranged in two rows extending in said *y* direction, the keys of one row being offset in the *y* direction with respect to the keys of the other row, through the space of approximately half the dimension of a key in said *y* direction.

4. The invention of claim 2, wherein said main keys are sufficiently long in said *x* direction so that two fingers of the player's hand may be simultaneously engaged with one of said keys without touching any other key.

5. The invention of claim 2, wherein said main keys are arranged in six rows extending in said *y* direction, the keys of each row being offset in the *y* direction with respect to the keys of an adjacent row, through the space of approximately half the dimension of a key in said *y* direction.

6. The invention of claim 1, wherein said second console, third console, and trestle unit are connected to each other and are mounted for collective movement relative to said first console in a horizontal $y$ direction from front to back, approximately perpendicular to said $x$ direction of movement of said manual with respect to said fixed support.

7. The invention of claim 1, wherein said trestle unit includes a movable control member on which the player's hand may rest and movable upwardly and downwardly in response to upward and downward movements of the hand resting thereon, the movements of said control member serving to control the volume of sound produced by said musical instrument.

8. The invention of claim 7, wherein said control member swings upwardly and downwardly about an oscillatory axis extending approximately horizontally.

9. The invention of claim 7, further comprising adjustable clamping means on said control member for engaging and clamping the side edges of a hand resting on said control member.

10. The invention of claim 7, further comprising means (27) for adjusting the position of said second console (12) in said $y$ direction relative to said trestle unit, to enable the second console to be placed in the most convenient position of actuation by the little finger of a hand resting on said trestle unit.

11. The invention of claim 1, further comprising a fret scale extending along said fixed support in said $x$ direction and reference point means carried by and movable with said manual for indicating the adjusted position of said manual along said fret scale.

12. The invention of claim 1, wherein there are two separate manuals each mounted for movement in said $x$ direction independently of the other, with respect to said fixed support, one manual being adapted for actuation by the right hand of a player and the other manual being adapted for actuation by the left hand of the player.

13. The invention of claim 1, wherein said main keys represent a tone scale of at least one octave but of substantially less range than the full tone scale capable of being produced by the instrument.

14. The invention of claim 13, wherein one or more of said special keys are intended to determine the part of the total tone scale of the instrument which is to be controlled by the main keys.

15. The invention of claim 1, wherein said special keys include keys representing control of and changes in the sounds produced as a result of playing said main keys, including changes in pitch, changes in entry curve and exit curve of sounds, production of reverberation, and repetition of notes produced by playing said main keys.

16. The invention of claim 1, wherein said special keys include two keys for operation by the thumb of the player and movable in directions approximately perpendicular to each other.

* * * * *